United States Patent [19]

Harness

[11] Patent Number: 4,648,192

[45] Date of Patent: Mar. 10, 1987

[54] FIREARM FOR FIRING AMMUNITION OF DIFFERENT CALIBER

[75] Inventor: John Harness, Hatton, England

[73] Assignee: Hilton Gun Company Limited, England

[21] Appl. No.: 678,960

[22] PCT Filed: Mar. 26, 1984

[86] PCT No.: PCT/GB84/00105

§ 371 Date: Nov. 21, 1984

§ 102(e) Date: Nov. 21, 1984

[87] PCT Pub. No.: WO84/03937

PCT Pub. Date: Oct. 11, 1984

[30] Foreign Application Priority Data

Mar. 26, 1983 [GB] United Kingdom ..... 8308348
Mar. 26, 1984 [WO] PCT Int'l Appl. ..... WO84/03937

[51] Int. Cl.[4] ..... F41C 3/00; F41C 21/10; F41C 21/22

[52] U.S. Cl. ..... 42/77; 42/75.04

[58] Field of Search ..... 42/77, 75 B, 75 C, 75 D; 102/446

[56] References Cited

U.S. PATENT DOCUMENTS 2,423,471 7/1947 Summerbell ..... 42/77
3,156,995 11/1964 Mellor .
3,251,267 5/1966 Hauser .
3,842,527 10/1972 Low .

FOREIGN PATENT DOCUMENTS 342190 11/1920 Fed. Rep. of Germany .
513262 11/1930 Fed. Rep. of Germany .
2495305 6/1982 France .
356839 9/1931 United Kingdom .

OTHER PUBLICATIONS

D. H. R. Archer, *Jane's Infantry Weapons,* Published in 1976, Jane's Yearbooks (London, GB) pp. 441, 442, 459.

*Primary Examiner*—Deborah L. Kyle
*Assistant Examiner*—Ted L. Parr
*Attorney, Agent, or Firm*—W. Thad Adams, III

[57] ABSTRACT

A firearm is disclosed which includes a gun body having a firing mechanism and a barrel mount movable between a barrel loading position and a firing position. The firing mechanism is maintained in inoperative condition unless the barrel mount is correctly positioned in the firing position. A shoulder stock is releasably mountable on the gun body to permit the firearm to be selectively usable in pistol or rifle form. A plurality of barrel parts are selectively mountable on the gun body and include a first barrel of a length capable of firing baton rounds and gas rounds and a first insert of a similar length adapted to be fitted from only the end adjacent to the barrel mount into the first barrel to provide a smaller caliber barrel. A second barrel of a shorter length than the first barrel is provided and is capable of firing flare rounds. A second insert of a similar length to the second barrel and adapted to be fitted only from the end adjacent the barrel mount into the second barrel to provide a smaller caliber barrel.

10 Claims, 5 Drawing Figures

FIREARM FOR FIRING AMMUNITION OF DIFFERENT CALIBER

Figure 1:
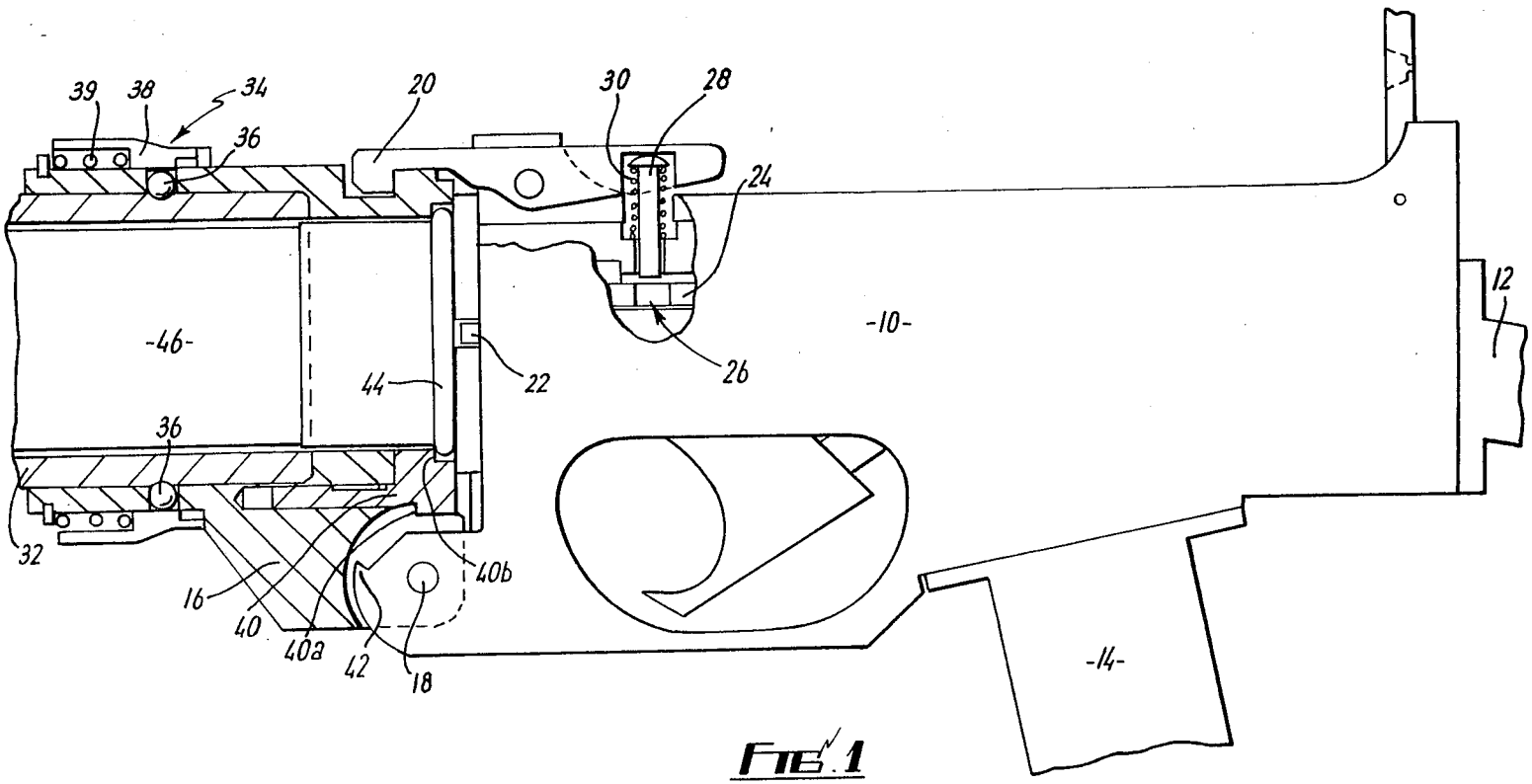

The invention relates to firearms, especially, though not exclusively, firearms for use by security forces for dispersing rioters and the like.

It is known to provide 'riot-gun' firearms to fire one of a number of different types of ammunition such as large- or small-calibre flare rounds, baton-rounds, gas cartridges and live ammunition such as shotgun rounds.

Unfortunately this has required the utilisation of a large number of firearms, and it is impracticable for a user to have to carry several firearms to suit different calibres or types of ammunition.

The invention provides a firearm comprising a gun body incorporating a firing mechanism, and having means mounting a barrel so that the latter is movable between a barrel loading position and a firing position, means maintaining the firing mechanism inoperative unless the barrel mounting means is correctly in the firing position, the body further having means for releasably mounting a shoulder stock whereby to be selectively usable in pistol form or rifle form, the firearm further comprising a kit of barrel parts which are selectively usable with the gun body and which include a first barrel of a length capable of firing baton rounds and gas rounds, an insert of a similar length adapted to be fitted from one end only, the end adjacent to the barrel mounting means, into the first barrel to provide a smaller calibre barrel, a second barrel of a smaller length than the first barrel capable of firing flare rounds, and an insert of a similar length to the second barrel adapted to be fitted from one end only, the end adjacent the barrel mounting means, into the second barrel to provide a smaller calibre barrel, the gun body selectively mounting the first or second barrel and the shoulder stock, and the selected barrel selectively receiving a respective insert whereby to provide for a multi-purpose firearm.

Preferably also the barrel mounting means of the gun body comprises a screw threaded arrangement co-operating with a screw threaded arrangement of the selected barrel. Alternatively the barrel mounting means of the gun body comprises a snap fit arrangement co-operating with parts of the selected barrel.

The selected barrel may comprise a recess for receiving a flanged end of the selected insert, whereby the latter is clamped between the barrel and a main part of the gun body.

In another arrangement a breech part of the gun body comprises a recess for receiving a flanged end of an insert arrangement, whereby the latter is clamped between the breech part and a main part of the gun body.

The insert arrangement may comprise a member within which the selected insert is mounted and which is adapted to space the selected insert from the barrel, the flanged end being provided on the spacing member.

Desirably means are provided on the gun body for ejecting spent cartridge cases, the ejecting means being adapted to co-operate either directly with the cases or indirectly with the cases by means of auxiliary ejecting means associated with the selected insert.

Figure 2A:
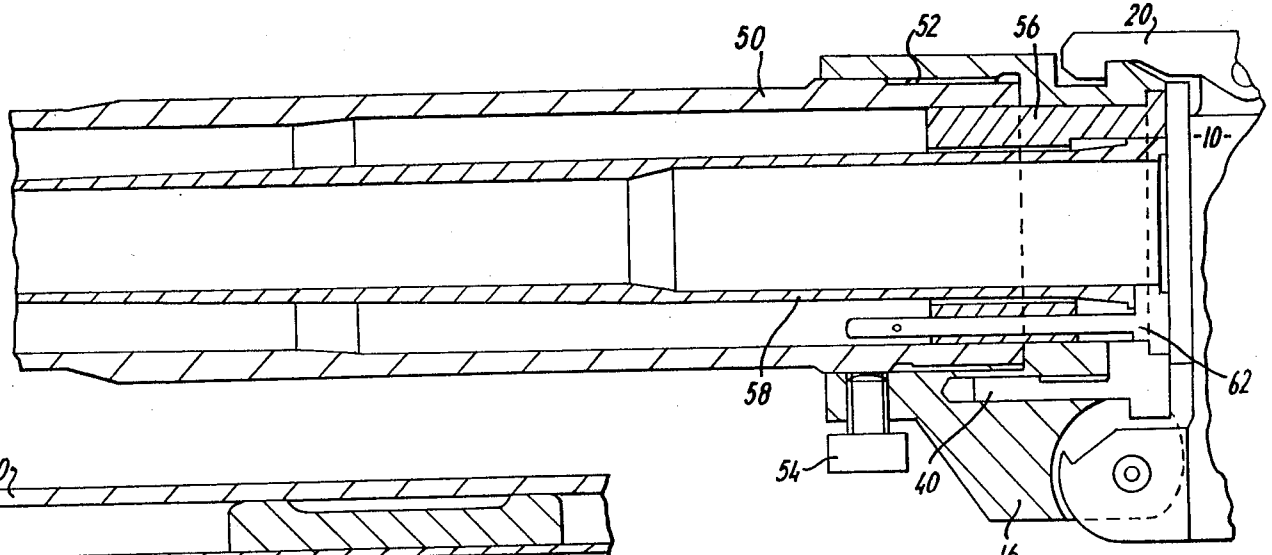
Figure 2B:
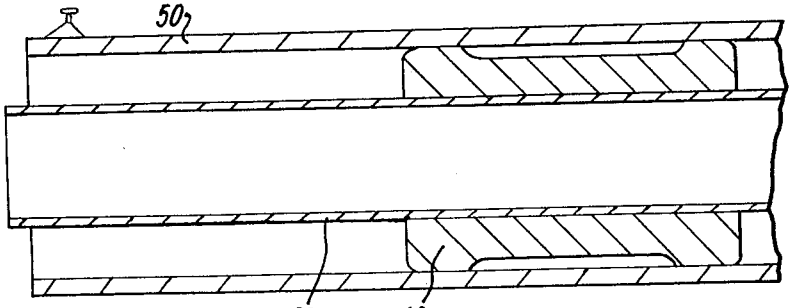
Figure 3:
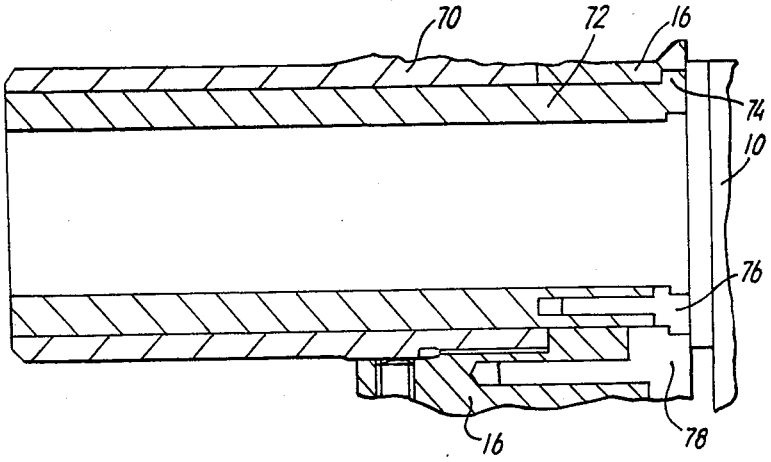
Figure 4:
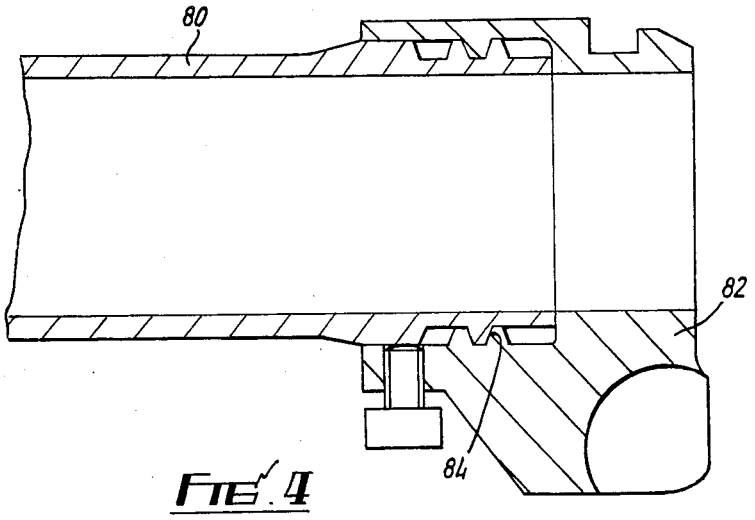

Embodiments of the invention will now be described by way of example only and with reference to the accompanying drawings, in which:

FIG. 1 is a schematic side elevational view of a firearm according to the invention, fitted with a large-calibre barrel, certain parts being shown in cross-section;

FIGS. 2*a* and 2*b* are schematic side elevational views of a front part of the firearm similar to that shown in FIG. 1, having fitted thereto a small-calibre barrel-insert inside the large-calibre barrel;

FIG. 3 is a cross-sectional view of a part of the firearm of FIG. 1, having fitted thereto a short large-calibre barrel with a small-calibre barrel insert therein; and FIG. 4 is a cross-sectional view of a part of the firearm shown in FIG. 1, showing an alternative barrel mounting.

FIG. 1 shows a firearm having a gun body 10 having a socket at a rear part for receiving a stock 12 and having a pistol grip 14. A breech block 16 is mounted on the gun-body 10 by means of a pivot 18, the breech block being secured to the gun-body for firing by a catch 20.

The gun-body 10 has a firing mechanism (only part of which is shown) including a firing pin 22, a part 24 of which is provided with an aperture 26. The latter can receive a locking pin 28 which is depressed against the urging of a spring 30, unless the catch 20 is properly engaged with the breech block 16. The firearm is thus prevented from firing unless the breech block is in proper engagement with the gun body 10. The breech block 16 receives the breech end of a barrel 32 in a sliding fit within a socket, the barrel being locked in place by a series of ball catches 34. These comprise a series of eight circumferentially-spaced ball bearings 36 which, in the locked position, have lower portions which can protrude into a circumferential groove provided on the outside of the barrel socket. The ball bearings 36 are held in this position by a sleeve 38 urged into a locked position by a spring 39. When slid aside against the spring 39 the sleeve 38 allows the ball bearings 36 to retract from the socket allowing the barrel 32 to be withdrawn.

The breech block 16 also incorporates a cartridge ejector mechanism comprising an ejector slide 40 having an abutment **40*a* which, when the breech is pivoted open, abuts a stop 42, on the gun body 10. The latter, as the breech is opened more, pushes the ejector slide 40 rearwardly relative to the breech block so that an abutment 40*b* ejects the rim of a cartridge 46. The barrel 32 shown in FIG. 1 is a 38 mm-calibre long barrel suitable for firing a baton-round (for example of rubber or plastics) or a gas-round. A short barrel 70 as shown in FIG. 3** and as described in more detail hereinafter can be fitted instead of the long barrel so that the weapon can be used as a pistol. The short barrel can be used for firing 38 mm-calibre flare rounds, or gas or baton-rounds, where accuracy is not required, or in an emergency..

FIGS. 2*a* and 2*b* show a firearm similar in most respects to that shown in FIG. 1 (and similar reference numerals have been used for corresponding parts), except that a barrel 50 is screw threaded into the breech block 16, and the firearm is shown with a small (12 gauge) calibre barrel insert 58 within the 38 mm-calibre barrel 50. FIG. 2*a* shows the rear part of the barrel 50, and FIG. 2*b* the front part.

The large calibre barrel 50 is attached to the breech block 16 by means of an external screw threaded section 52 and is prevented from unscrewing by means of a locking screw 54 which is tightened on to an outer surface of the barrel socket. A barrel-insert assembly is received within the barrel 50 and comprises a rear spacing block 56 into which is threadingly engaged the barrel insert 58. A forward spacing block 60 (see FIG. 2*b*) spaces the small-calibre barrel insert 58 within the barrel 50 at a front end of the latter. The cartridge ejector slide 40 instead of acting on the rim of a cartridge, acts on an abutment of a secondary ejector 62 which is part of the spacing block 56 and which acts on the rim of a cartridge in the small-calibre barrel insert 58 to eject the cartridge case.

FIG. 3 shows part of the breech block 16 of the firearm of FIG. 1 incorporating the short barrel 70 as an alternative to the long 38 mm-calibre barrel 32. There is also shown a small 1"-calibre barrel insert 72 (for firing small baton or flare rounds) retained in the barrel 70 by means of a flange 74 corresponding to the rim of a large-calibre cartridge. A secondary ejector 76 is provided which is operated by an ejector slide 78 of the large-diameter barrel 70 in a manner the same as that described in relation to the firearm shown in FIG. 2*a*.

FIG. 4 shows an alternative type of screw thread arrangement for securing a barrel 80 to a breech block 82, by means of an 'acme' thread 84.

It is to be understood that various modifications may be made without departing from the invention. For example, any convenient fixing of a barrel in the breech block may be employed, the examples shown being the screw-thread and snap-fit arrangements. A permanent barrel may be provided on a breech block within which barrel inserts of other calibres may be received by any suitable means in addition to those described, the breech block being rapidly interchangeable with another breech block having a permanent or detachable barrel. The breech block may be secured for example by a releasable pivot pin.

The firearm may be made from any suitable material such as alloy, pure metal, and where appropriate, plastics. Where a long barrel is fitted, an additional hand-grip may be fitted about half way along the barrel. The hand-grip(s) and/or stock may be provided with rings to accommodate a sling.

The barrel or any of the barrels may be rifled where appropriate. Each barrel or barrel insert (when fitted) may be used to fire any appropriate ammunition. For example the 12-gauge barrel may be used to fire a gas, buckshot, or slug-round (for example to kill escaped dangerous animals).

I claim:

1. A firearm comprising:

(a) a gun body including a firing mechanism and means mounting a barrel movable between a barrel loading position and a firing position;

(b) means maintaining the firing mechanism inoperative unless the barrel mounting means is correctly in the firing position;

(c) means for releasably mounting a shoulder stock to permit the firearm to be selectively usable in pistol form or rifle form; and (d) a plurality of barrel parts selectively mountable on said gun body and which include:

(i) a first barrel of a length capable of firing baton rounds and gas rounds, a first insert of a similar length adapted to be fitted from only the end adjacent to the barrel mounting means into the first barrel to provide a smaller calibre barrel;

(ii) a second barrel of a shorter length than the first barrel and capable of firing flare rounds, a second insert of a similar length to the second barrel adapted to be fitted from only the end adjacent the barrel mounting means into the second barrel to provide a smaller calibre barrel.

2. A firearm according to claim 1, wherein the barrel mounting means of the gun body comprises screw threads co-operating with mating screw threads of the selected first or second barrel.

3. A firearm according to claim 2, wherein releasable locking means are provided to lock the selected first or second barrel in position in the gun body.

4. A firearm according to claim 1, wherein the barrel mounting means of the gun body comprises a snap fitting means co-operating with complementary parts of the selected first or second barrel.

5. A firearm according to claim 4, wherein the snap fitting means comprises a plurality of ball catches engageable in a circumferential groove in the first or second selected barrel, and a sleeve movably mounted on the gun body to move the ball catches into a locking position.

6. A firearm according to claim 1, 2, 3 or 4 wherein the selected first or second barrel comprises a recess for receiving a flanged end of the selected first or second insert, whereby the latter is clamped between the barrel and a main part of the gun body.

7. A firearm according to claim 2, 3 or 4 wherein a breech part of the gun body comprises a recess for receiving a flanged end of the first or second insert, whereby the latter is clamped between the breech part and a main part of the gun body.

8. A firearm according to claim 7, wherein the first or second insert includes a member for spacing the selected insert from the barrel.

9. A firearm according to claim 8, wherein the selected first or second insert is releasably mounted in the spacing member.

10. A firearm according to claim 2, 3 or 4, and including ejecting means provided on the gun body for ejecting spent cartridge cases, the ejecting means adapted to co-operate either directly with the cases or indirectly with the cases by means of auxiliary ejecting means associated with the selected insert.

* * * * *